US007818929B2

(12) United States Patent
Fiutak et al.

(10) Patent No.: US 7,818,929 B2
(45) Date of Patent: Oct. 26, 2010

(54) LAMINATED SUPPORT MAT

(75) Inventors: Jon C. Fiutak, Cape Elizabeth, ME (US); Joe C. Ehrhart, Jr., Silsbee, TX (US); Kevin W. Fleming, Sheridan, AK (US)

(73) Assignee: Anthony Hardwood Composites, Inc., Sheridan, AR (US)

( * ) Notice: Subject to any disclaimer, the term of this patent is extended or adjusted under 35 U.S.C. 154(b) by 879 days.

(21) Appl. No.: 11/496,104

(22) Filed: Jul. 31, 2006

(65) Prior Publication Data

US 2006/0265976 A1 Nov. 30, 2006

(51) Int. Cl.
*E04C 5/08* (2006.01)

(52) U.S. Cl. ..... 52/223.7; 52/222; 52/177

(58) Field of Classification Search ..... 404/36, 404/46, 17, 34, 35; 52/177, 223.9, 222, 223.6, 52/223.7

See application file for complete search history.

(56) References Cited

U.S. PATENT DOCUMENTS

| | | | | |
|---|---|---|---|---|
| 3,325,037 | A | 6/1967 | Kohn et al. | |
| 3,447,996 | A | 6/1969 | Himmelheber et al. | |
| 3,905,172 | A | 9/1975 | Blackburn | |
| 4,078,348 | A | 3/1978 | Rothman | |
| 4,271,649 | A | 6/1981 | Belanger | |
| 4,312,908 | A | 1/1982 | Jasperson | |
| 4,533,589 | A | 8/1985 | Sewell | |
| 4,784,887 | A | 11/1988 | Abendroth | |
| 4,801,483 | A | 1/1989 | Beckerman et al. | |
| 4,932,178 | A * | 6/1990 | Mozingo | 52/223.7 |
| 4,965,973 | A | 10/1990 | Engebretsen | |
| 5,002,105 | A | 3/1991 | Bodig | |
| 5,087,149 | A | 2/1992 | Waller, Jr. | |
| 5,097,558 | A | 3/1992 | Accorsi et al. | |
| 5,282,692 | A | 2/1994 | McLeod | |
| 5,305,568 | A | 4/1994 | Beckerman | |
| 5,313,758 | A | 5/1994 | Willman et al. | |
| 5,362,545 | A | 11/1994 | Tingley | |
| 5,482,754 | A * | 1/1996 | Crook | 428/54 |

(Continued)

FOREIGN PATENT DOCUMENTS

CH 663980 A5 1/1988

(Continued)

OTHER PUBLICATIONS

"Acceptance Criteria for Structural Composite Lumber", ICBO Evaluation Service, Inc., Copyright 2002.

(Continued)

*Primary Examiner*—Richard E Chilcot, Jr.
*Assistant Examiner*—Jessica Laux
(74) *Attorney, Agent, or Firm*—MacMillan, Sobanski & Todd, LLC

(57) ABSTRACT

A support mat, such as a mat suitable for supporting heavy construction equipment, includes a plurality of billets fastened together, each of the billets being made of a plurality of individual wood laminations adhesively bonded to each other. The billets comprise a plurality of vertically oriented individual wood laminations. The plurality of individual wood laminations has wide faces oriented parallel to a direction of a load applied to the support mat. Each billet has outboard laminations and the wide faces of the outboard laminations of each billet define a wide face of the billet. An expansion pad is disposed between the wide faces of adjacent billets.

24 Claims, 5 Drawing Sheets

U.S. PATENT DOCUMENTS

| | | | | |
|---|---|---|---|---|
| 5,565,257 | A | 10/1996 | Tingley | |
| 5,603,134 | A | 2/1997 | Whipkey et al. | |
| 5,736,218 | A | 4/1998 | Iwata et al. | |
| 5,756,975 | A | 5/1998 | Harris et al. | |
| 6,050,047 | A | 4/2000 | Covelli et al. | |
| 6,214,428 | B1 * | 4/2001 | Henderson | 428/54 |
| 6,224,704 | B1 | 5/2001 | Bassett et al. | |
| 6,281,148 | B1 | 8/2001 | Dagher et al. | |
| 6,592,962 | B2 | 7/2003 | Edwards | |
| 7,137,226 | B2 * | 11/2006 | Fiutak et al. | 52/223.7 |
| 2002/0188074 | A1 | 12/2002 | Parker et al. | |
| 2003/0113162 | A1 | 6/2003 | Seaux et al. | |
| 2003/0133751 | A1 | 7/2003 | Smith | |
| 2004/0042851 | A1 * | 3/2004 | Davis et al. | 404/35 |

FOREIGN PATENT DOCUMENTS

| | | |
|---|---|---|
| JP | 10-115026 | 5/1998 |
| JP | 10-237982 | 9/1998 |
| WO | WO2004005646 | 1/2004 |

OTHER PUBLICATIONS

"Adhesive Bonding of Wood Materials", Charles B. Vick pp. 9-1-9-24.

"Building Materials" by Engineered Wood Products by Williamette retrieved from www.wii.com on Dec. 21, 2001.

Georgia-Pacific Engineered Lumber Products, G-P Lam Beams and Headers retrieved from www.gp.com on Dec. 21, 2001.

George-Pacific, Brochure/Flyer on Laminated Veneer Lumber (LVL).

"Laminating Effects in Glued-Laminated Timber Beams" by Robert H. Falk et al. From Journal of Structural Engineering, Dec. 1995, pp. 1857-1863.

Laminated Veneer Lumber, LVL, Overview of the Product, Manufacturing and Market Situation by Department of Forest Products Marketing, www.hochstrate.de/micha/reports/replvl.html dated Dec. 21, 2001.

Laminated Veneer Lumber, LVL, StrucLam by Williamette, http://www.wii.com/LVL1.html dated Dec. 21, 2001.

Numerical Investigations of the Laminating Effect In Laminated Beams: by Erik Serrano et al., Journal of Structural Engineering dated Jul. 1999, pp. 740-745.

Boise Cascade Engineered Wood Products Division, Versa-Lam Products, www.bcewp.com , Dec. 21, 2001.

* cited by examiner

LAMINATED SUPPORT MAT

BACKGROUND OF THE INVENTION

Various embodiments of a laminated support mat are described herein. In particular, the embodiments described herein relate to an improved laminated support mat and a method of manufacturing such an improved laminated support mat.

The construction industry utilizes solid sawn wood and wood panel members in a variety of forms to aid in the erection of buildings, roads, and bridges. For example, temporary road panels and crane mats are often constructed using solid-sawn hardwood timbers or some species of softwoods. These panels are used to form a temporary lightweight roadway or foundation to facilitate vehicular and equipment travel as may be required in construction operations. Other industry users of such mats include users in the field of pipeline, utility, transportation, oil, and infrastructure.

As shown in FIG. 1, a conventional road panel, shown generally at 10, is formed by using a plurality of solid sawn timber elements 12. Typically, four pieces of solid sawn timber 12 are used, each having a cross-sectional dimension ranging from about 8 inches by 8 inches to about 12 inches by 12 inches, with a length of 16 feet. The four pieces of timber 12 are usually bolted together using bolts 14 to form the temporary road panel 10 having an assembled dimension of 4 feet by 1 foot by 16 feet. Several panels may be placed side by side over existing ground to form a temporary roadway or to support cranes on a construction site. Ground conditions under the panels vary greatly and may include, for example, sand, clay, wetlands, and possibly a considerable amount of water. Another conventional wood mat utilizes smaller dimensional lumber and utilizes nails, carriage bolts, or steel rods as a fastening system. All of these systems have mechanical fastening systems to transfer stresses between components. Additionally, U.S. Pat. No. 4,932,198 discloses a compound timber-metal stressed deck with metal plates inserted between the timbers.

The hardwood panels are typically discarded at the end of the construction project, or they may be re-used if they are in relatively good condition. The longevity of the panels may be as little as six months to one year, depending on the length of the construction project and the environmental conditions to which the panels are subjected. The wood panels are typically untreated with preservative chemicals because of environmental concerns. Hardwoods are typically used because of their superior wear resistance to heavy truck and other construction equipment traffic. In addition to road panels and crane mats, other applications for the hardwood panels include decks over steel girders for temporary bridges, and soldier piles.

Because the timber used to form the panel 10 is expensive, the panel 10 is very costly. Further, the roadway formed by the panels 10 is very costly because tens of thousands of the panels 10 may be used for a single construction project. In addition, the solid sawn timber used to form the panel 10 is scarce because of the solid sawn timber must be extremely long, typically about sixteen feet in length. Exposure to larger amounts of water or moisture for extended periods of time causes a portion of the panel 10 to swell or expand. Such expansion of the panel 10 causes undesirable cupping and/or buckling of the panel 10. Therefore, it would be desirable to provide an improved laminated support mat for supporting heavy equipment.

SUMMARY OF THE INVENTION

The present application describes various embodiments of a laminated support mat and its method of manufacture. One embodiment of the laminated support mat, such as a mat suitable for supporting heavy construction equipment, includes a plurality of billets fastened together, each of the billets being made of a plurality of individual wood laminations adhesively bonded to each other. The billets comprise a plurality of vertically oriented individual wood laminations. The plurality of individual wood laminations has wide faces oriented parallel to a direction of a load applied to the support mat. Each billet has outboard laminations and the wide faces of the outboard laminations of each billet define a wide face of the billet. An expansion pad is disposed between the wide faces of adjacent billets.

Other advantages of the laminated support mat and its method of manufacture will become apparent to those skilled in the art from the following detailed description, when read in light of the accompanying drawings.

DETAILED DESCRIPTION OF THE INVENTION

Figure 2:
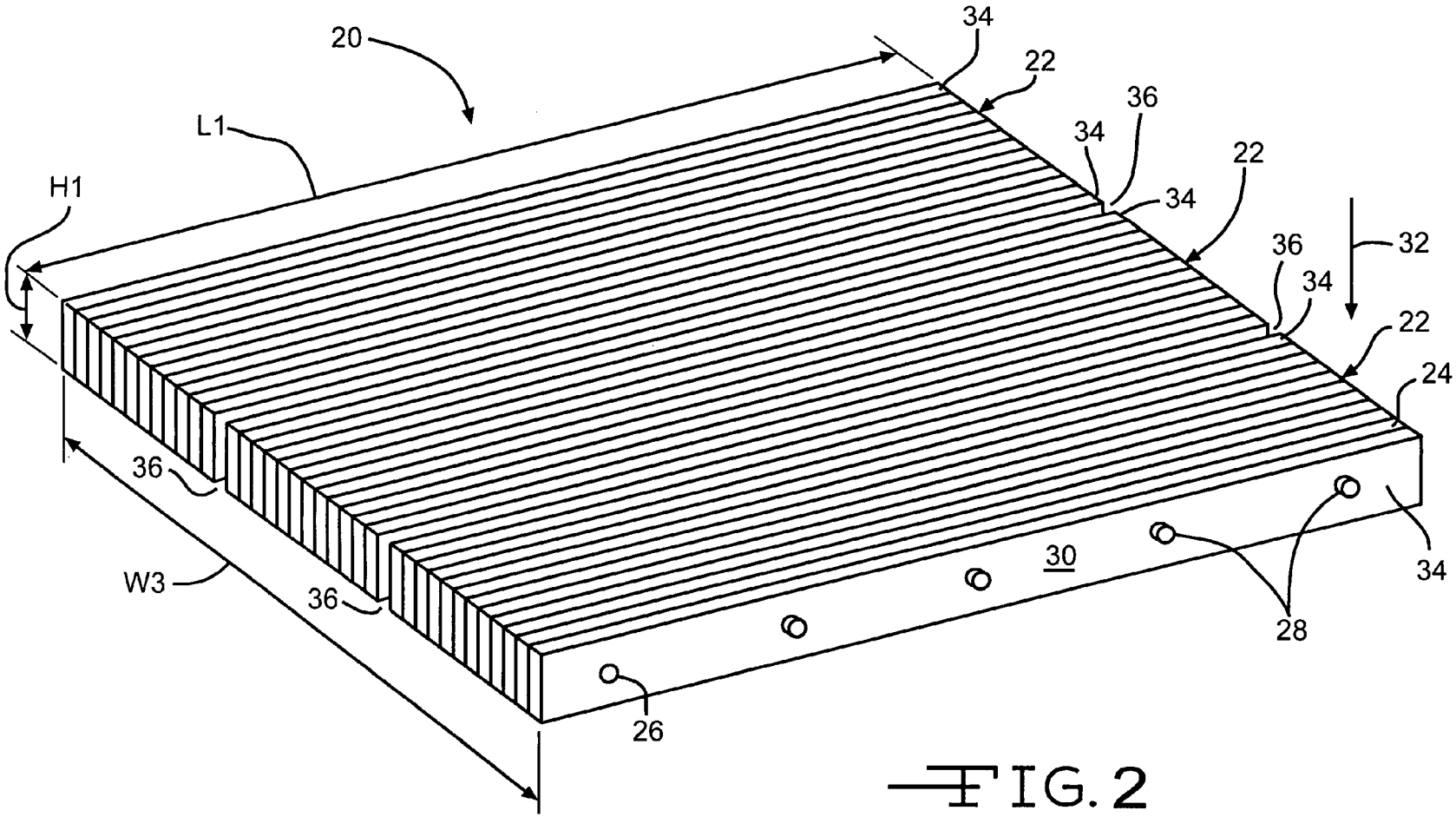
FIG. 2 is a partial side perspective view of a first embodiment of a laminated support mat.

Referring now to FIG. 2, a first embodiment of a laminated support mat is indicated generally at 20. The illustrated mat 20 is comprised of a plurality of laminated beams or billets 22. Each of the illustrated billets 22 comprises a plurality of wood members or individual wood laminations 24. If desired, apertures 26 may be formed through the support mat 20 for receiving fastening means, such as the bolts 28, as will be described in detail herein. As used in the description of the invention, the term "mat" includes mats as well as panels. One example of such a support mat 20 is described in co-assigned U.S. patent application Ser. No. 11/011,724, herein incorporated by reference in its entirety.

The individual wood laminations 24 may be fabricated by structurally joining together arbitrary or different lengths or strips of wood or wood material. The arbitrary strips of wood material may be disposed end-to-end and joined together, such as by a jointing process. One example of such a jointing process is finger jointing. It will be understood that the strips may be continuous and full length. The arbitrary strips of wood may be strips of hardwood, such as oak, birch, or maple, although any desired hardwood or softwood may be used. The strips of wood laminations 24 may be any length, such as a length within the range of from about 5 feet to about 16 feet. The strips of wood material may be joined together to define the individual wood laminations 24 of any desired length, such as individual wood laminations having a length of about 16 feet. It will be understood however, that the individual wood laminations 24 may be of any other desired length. Not all the wood laminations 24 need to be formed by joining together the strips, and the billet may be formed with some of the laminations formed by joined strips, and some of the wood laminations 24 being a continuous piece of full length wood. In one embodiment of the billet 22, at least 50 percent of the wood laminations are made of strips joined together.

Figure 3:
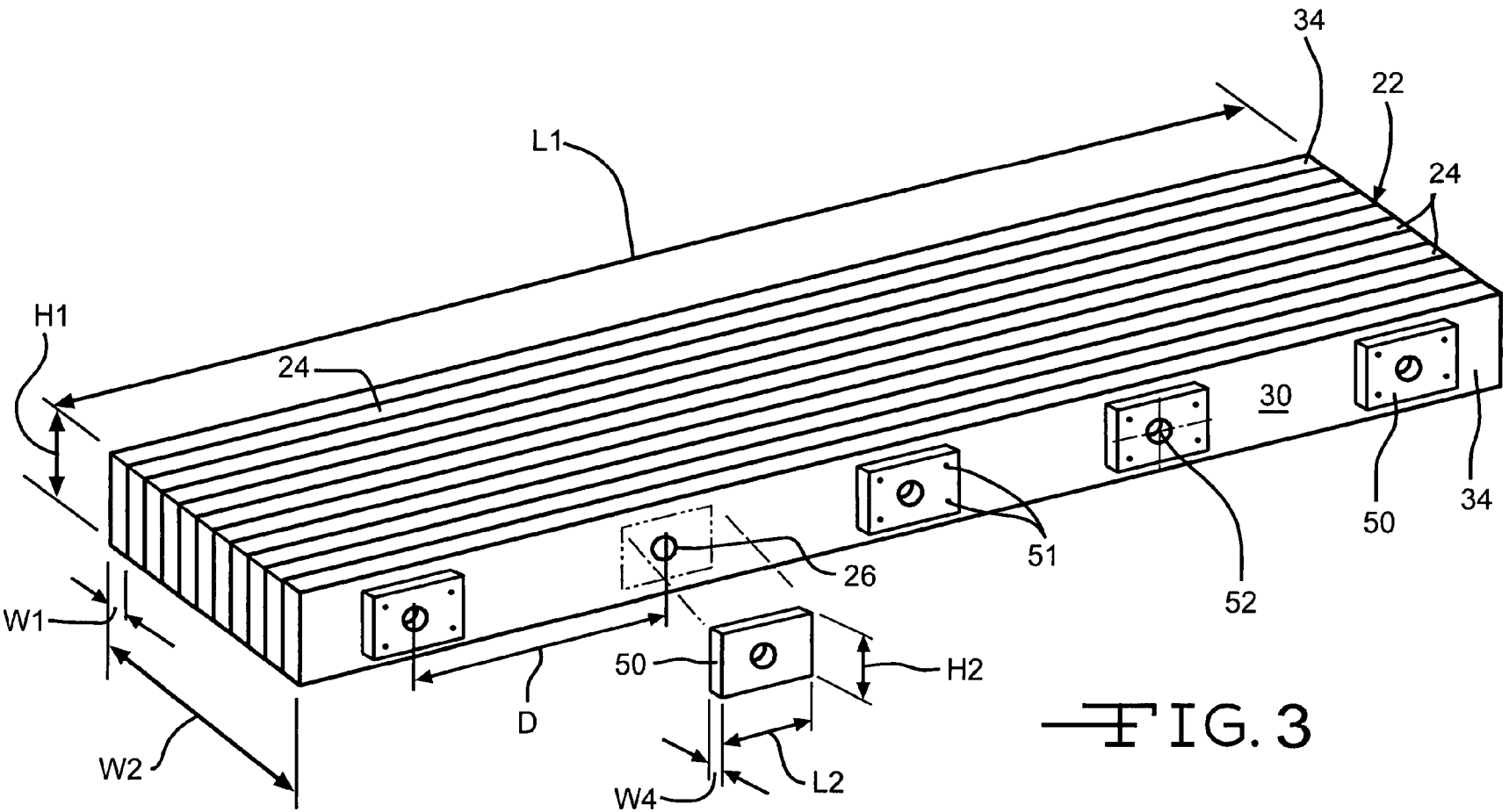
FIG. 3 is a partial side perspective view of a billet illustrated in FIG. 2.

As best shown in FIG. 3, the individual wood laminations 24 have a thickness or height H1, a thickness or width W1, and a length L1. The laminations 24 may have any desired length L1, such as, for example, a length of about 12 feet. It will be understood however, that the laminations 24 may have any other desired length. Examples of other suitable lamination lengths L1 include 14 feet, 16 feet, 18 feet, and 20 feet. In one embodiment, the individual wood laminations 24 have a height H1 within the range of from about 3 inches to about 6 inches. In another embodiment, the individual wood laminations 24 have a height H1 of about 5½ inches. In another embodiment, the individual wood laminations 24 have a width W1 within the range of from about 0.50 inches to about 1.00 inches. It will be understood however, that the individual wood laminations 24 may have any desired height H1, width W1, and length L1.

In the embodiment illustrated in FIG. 2, a plurality of the individual wood laminations 24 are joined together to form the laminated billets 22. The illustrated individual wood laminations 24 are vertically oriented, having a wide face 30 oriented parallel to a direction of a (load indicated by the arrow 32) applied to the laminated billet 22.

The individual wood laminations 24 may be joined together into the billet 22 using any desired adhesive. The individual wood laminations 24 may be joined together with a waterproof adhesive, such as an adhesive that conforms to ASTM D2559-01. Any desired number of individual wood laminations 24 may be joined together to form the laminated billet 22. In one embodiment, with the range of from about 20 laminations to about 30 laminations are joined together to form the billet 22. In another embodiment, about 26 laminations are assembled together to form the laminated billet 22. Each billet 22 includes outboard laminations 34, as shown in FIG. 3. The wide faces of the outboard laminations 34 of each billet 22, such as the wide face 30, define a wide face of the billet 22.

As best shown in FIG. 3, the laminated billet 22 has a height H1, a width W2, and a length L1. It will be understood that the laminated billet 22 may have any desired width W2. A typical laminated billet 22 may contain within the range of from about 14 laminations to about 16 laminations and have a width W2 of about 12 inches. In the illustrated embodiment, the length L1 of the laminated billets 22 is equal to the length L1 of the laminations 24, and the height H1 of the laminated billets 22 is equal to the height H1 of the laminations 24.

A plurality of laminated billets 22 may be attached to one another by any suitable means to form the laminated support mat 20. In the embodiment illustrated in FIG. 2, the billets 22 are assembled together with a fastener, such as the bolts 28 that extend through bolt apertures 26. It will be understood that any other desired fastener may be used. Adhesive, binding wire, shear connections, or brackets, all not shown, may also be used to connect the laminated billets 22 together into the mat 20. These mechanical fastening systems allow stresses to be transferred between components. An adhesive may also be used in conjunction with a mechanical fastening system.

Figure 4:
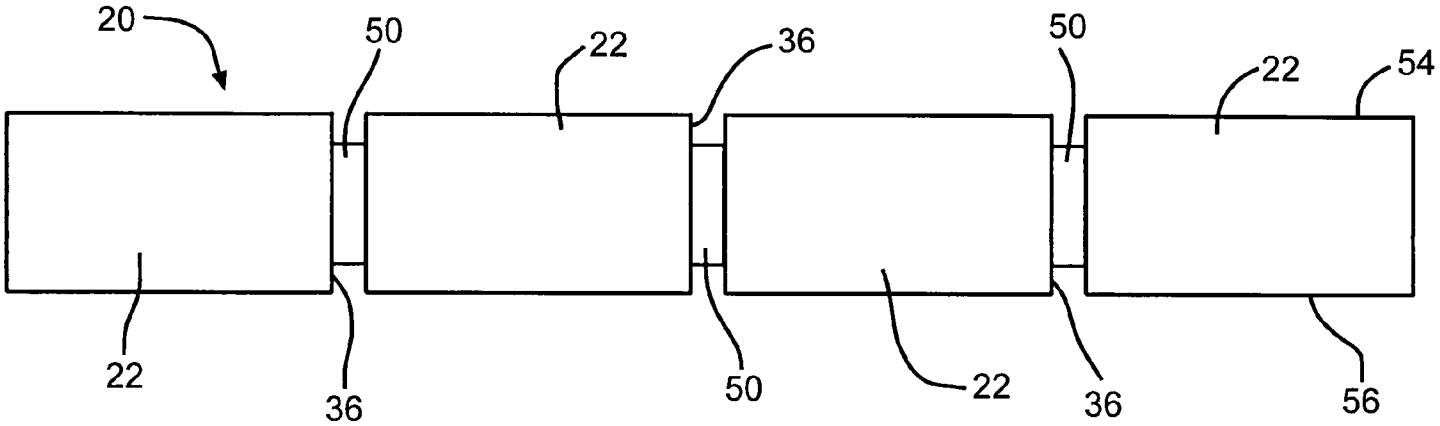
FIG. 4 is a schematic end view of the laminated support mat illustrated in FIG. 2.

In the embodiments illustrated in FIGS. 2 and 4, a plurality of laminated billets 22 is attached to one another to form the support mat 20. In the illustrated embodiment, the wide faces 30 of the outboard laminations 34 of adjacent billets 22 are disposed such that a space 36, the purpose of which will be described in detail below, is defined between the adjacent billets 22. The three laminated billets 22 illustrated in FIG. 2 further define a width W3 for the entire support mat 20. It will be understood that the support mat 20 may have any desired width W3. As best shown in FIG. 2, the support mat 20 also has a height H1 and a length L1. It will be understood that the support mat 20 may have any desired width W3.

Although the embodiment illustrated in FIG. 2 includes three billets 22 and the embodiment illustrated in FIG. 4 include four billets 22, it will be understood that any desired number of laminated billets 22 may be attached to one another to form the support mat 20. Also, the laminated billets 22 need not all be of the same width W2, but may be of different widths W2. Examples of suitable mat widths W3 include widths of 4 feet and 8 feet.

Although the billets 22 are shown as having individual wood laminations 24 of a generally uniform width W1, it will be understood that the billets 22 may be made of individual wood laminations 24 that vary in thickness across the width W2 of the billet 22. Also, it will be understood that the billets 22 on the outboard sides the mat 20 need not be identical to each other or to the billet/billets 22 in the central portion of the mat 20.

Figure 6:
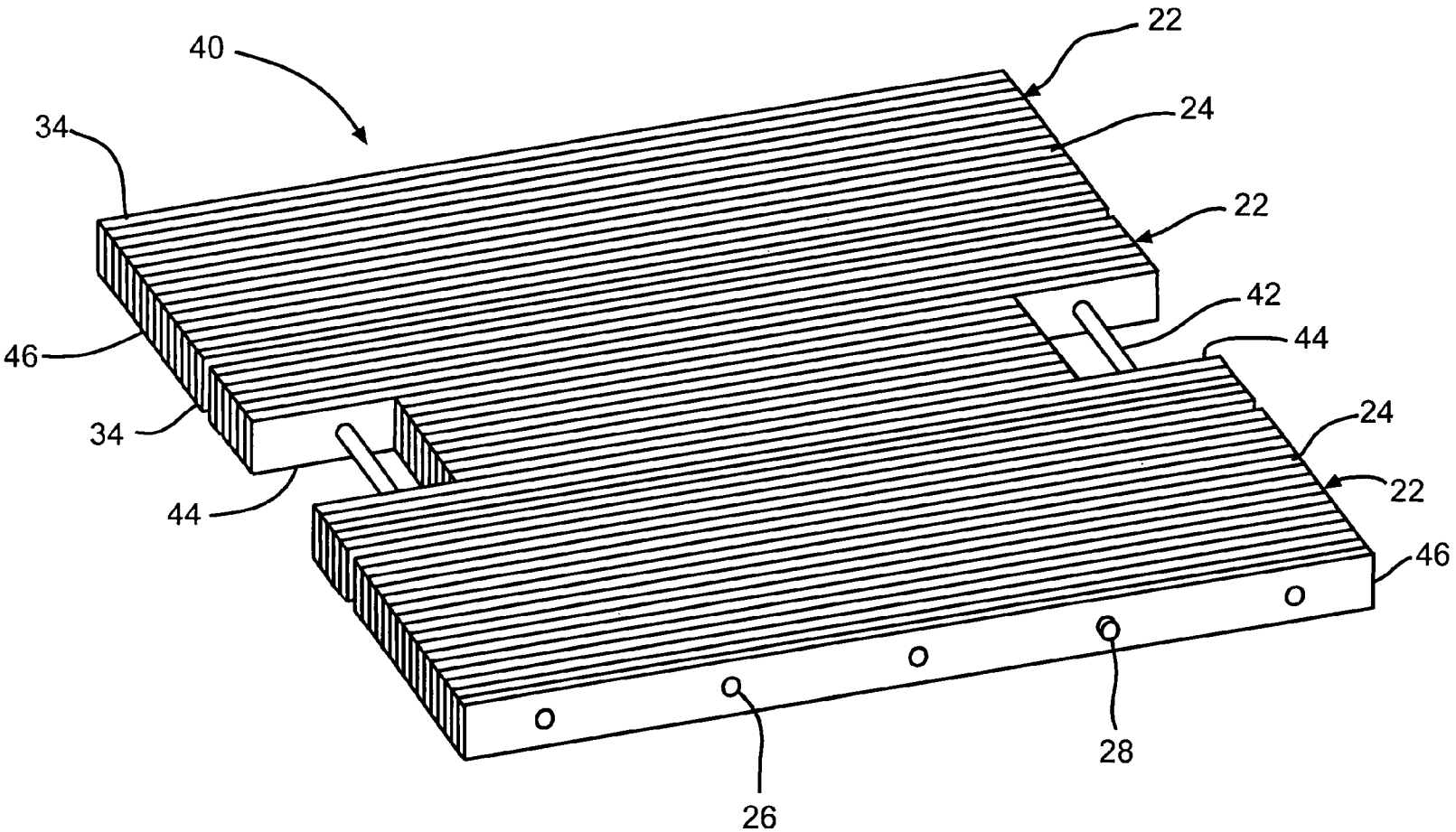
FIG. 6 is an isometric side view of a second embodiment of a laminated support mat.

Referring now to FIG. 6, a second embodiment of a laminated support mat is indicated generally at 40. The illustrated mat 40 is comprised of a plurality of the laminated billets 22. Each of the illustrated billets 22 comprises a plurality of the individual wood laminations 24. Apertures 20 are formed through the support mat 40 for receiving the fastening bolts 28, as described in detail herein above.

As best shown in FIG. 6, the billets 22 may be provided with one or more lifting members 42 for the attachment of lifting cables, not shown. The lifting members 42 may be positioned within recesses 44 formed at any location along an edge 46 of the support mat 40. It will be understood that any number of recesses 44 and/or lifting members 42 may be provided on the edges 46 of the mat 40. It will be further understood that the recesses 44 may be formed at any location along the edges 46 of the support mat 40.

Referring again to FIG. 3, an embodiment of an expansion pad is indicated generally at 50. In the illustrated embodiment, a plurality of the expansion pads 50 is shown disposed on the wide faces 30 of the outboard laminations 34, and within the space 36 between adjacent billets 22. It will be understood that any number of pads 50 may be disposed within the space 36 between adjacent billets 22, such as for example, one pad 50.

The plurality of expansion pads 50 may be positioned having any desired distance between adjacent pads 50. In the illustrated embodiment, a center 52 of each expansion pad 50 is spaced a distance D from the center 52 of an adjacent expansion pad 50. In one embodiment, a center 52 of each expansion pad 50 is spaced about 24 inches from the center 52 of an adjacent expansion pad 50. Alternatively, the expansion pads 50 may be spaced at any desired distance from one another. If desired, the pads 50 may be secured by any suitable means to the wide faces 30 of the outboard laminations 34 prior to the billets 22 being assembled together with the bolts 28. Examples of suitable means to secure the pads 50 to the wide faces 30 of the outboard laminations 34 include staples 51, nails, adhesive, and the like.

In the illustrated embodiments, the pads 50 are positioned such that the bolts 28 extend through an aperture at the center 52 of the pads 50. It will be understood that the mat 20, 40 may be assembled such that the bolts 28 extend through any desired portion of the pads 50, extend through only a portion of the pads 50, or do not extend through any pads 50.

The expansion pad 50 may have any desired thickness or width W4. In one embodiment of the expansion pad 50, the pad 50 has a width W4 within the range of from about 0.375 inches to about 0.625 inches. In another embodiment of the pad 50, the pad 50 has a width W4 of about 0.375 inches.

The expansion pad 50 may have any desired length L2. In one embodiment of the expansion pad 50, the pad 50 has a length L2 within the range of from about 3 inches to about 12 inches. In another embodiment of the pad 50, the pad 50 has maximum length L2 of about 12 inches.

The expansion pad 50 may have any desired height H2. In one embodiment of the expansion pad 50, the pad 50 has a height H2 within the range of about 70 percent to about 80 percent of the height H1 of the wide face 30 of the billet 22. In another embodiment of the pad 50, the pad 50 has a height H2 of about 75 percent of the height H1 of the wide face 30 of the billet 22.

The expansion pad 50 may be formed from any desired material having the properties of good mechanical strength, high ozone and weather resistance, good aging resistance, low flammability, good resistance toward chemicals, moderate oil and fuel resistance, and adhesion to many substrates. One embodiment of a material for the expansion pad 50 has a shore A hardness (shore A hardness is the relative hardness of elastic materials, typically determined with a Shore A durometer) within the range of from about 40 to about 50, an elongation at rupture within the range of from about 100 percent to about 70 percent, and a moderate resistance to weathering, ozone, gas, diesel, mineral oil, and hydraulic fluid. Examples of suitable materials for the expansion pad 50 include chloroprene or polychloroprene (CR) rubber, and natural rubber.

In the embodiment illustrated in FIG. 4, the support mat 20 is substantially symmetrical and includes a first support surface 54 (upwardly facing as viewed in FIG. 4) and a second support surface 56 (downwardly facing as viewed in FIG. 4) opposite the first support surface 54. Each of the first and second support surfaces 54 and 56 define a substantially flat surface. Accordingly, either of the first and second support surfaces 54 and 56 may be placed against a surface, such as the ground, at a construction site. The other of the first and second support surfaces 54 and 56 thereby faces upwardly to support objects, such as vehicles, equipment, and the like.

Figure 5:
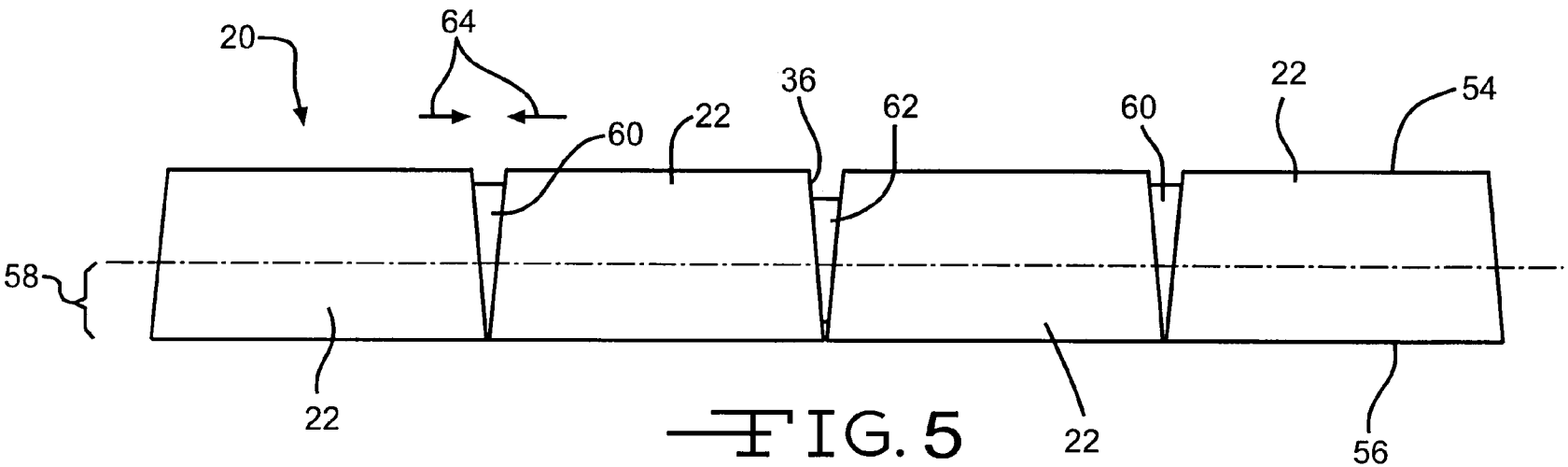
FIG. 5 is a schematic end view of the laminated support mat illustrated in FIGS. 2 and 4, showing the laminated support mat after expansion.

When only a portion of the support mat 20, such as a region 58 adjacent only one support surface (such as the second support surface 56 illustrated in FIG. 5) experiences prolonged exposure to water or other moisture over a period of time, swelling or expansion of the support mat 20 may occur asymmetrically. As a result of such asymmetrical expansion, the region 58 adjacent only one support surface (the second support surface 56 in the illustrated embodiment) expands substantially as shown in FIG. 5. It will be understood that the period of time that the support mat 20 must be exposed water or other moisture before the illustrated expansion occurs may vary based on the type of wood and/or laminates used and the environmental conditions extant at the site the mat 20 is used. Typically, such expansion of the region 58 may occur after the region 58 of the mat 20 has been continuously submerged in water for within the range of from about two weeks to about 3 weeks.

The expansion pads 50, disposed between each adjacent billet 22, permit the asymmetrical expansion of the billets 22 in the region 58, while preventing the support mat 20 from undesirably cupping and/or buckling and thereby allowing the first and second support surfaces 54 and 56 to remain substantially flat. As the region 58 of the billets 22 expand, the pads 50 are compressed inwardly (as indicated by the arrows 64 in FIG. 5) such that portions of the pad 50 are caused to extend upwardly and downwardly (as viewed in FIG. 5). The pads 50 may extend upwardly and downwardly substantially to or near the first and second support surfaces 54 and 56, as shown at 60 in FIG. 5. Alternatively, portions of the pad 50 may be caused to extend upwardly and downwardly (as viewed in FIG. 5) through only a portion of the distance to the first and second support surfaces 54 and 56, as shown at 62 in FIG. 5.

Advantageously, a mat, such as the illustrated embodiment of the mat 20, having the expansion pads 50 disposed between each adjacent billet 22, has been shown to substantially eliminate cupping and/or buckling of the mat 20 after prolonged exposure to water.

Use of the pads 50 as described herein has been shown to be particularly effective in substantially eliminating cupping and/or buckling in mats having an aspect ratio greater than 13. As used herein, aspect ratio is defined as:

support mat width W3/support mat height H1.

It will be understood however, that the pads 50 may be used and effective in substantially eliminating cupping and/or buckling in mats having an aspect ratio of 13 or less.

Another advantage of the embodiments of the support mat 20 described herein is that the laminated billets 22 have an allowable design strength value greater than about 3000 psi. Bending strength is measured, destructively, using a four-point bending test apparatus such as described in ASTM D198-00, with the wide face of the laminations parallel to the direction of applied load. Such a design strength value greater than about 3000 psi is superior to known sawn timber billets which typically have a strength value within the range of from about 650 psi to about 700 psi.

Figure 1:
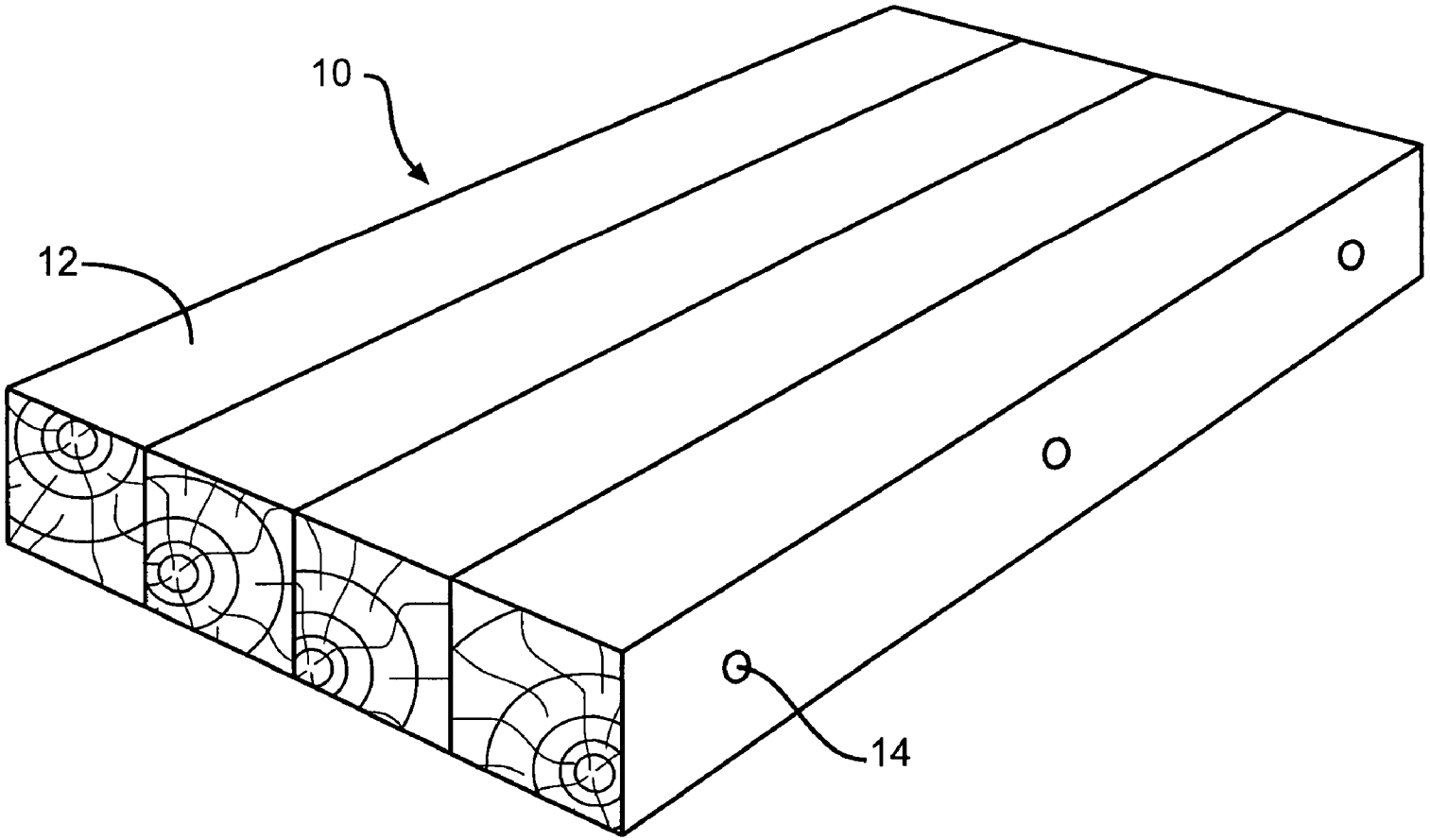
FIG. 1 (PRIOR ART)
FIG. 1 is a side perspective view of a prior art panel formed of solid sawn timber.

Another advantage of the embodiments of the support mat 20 described herein is that the support mat 20 has a smaller height H1 relative to known wood mats, such as the prior art mat 10 in FIG. 1. The support mat 20 is thereby easier to move and to store, requires a smaller amount of wood material, and efficiently uses raw material resources to make the mat less costly.

Another advantage of the embodiments of the support mat 20 described herein is that the mats 20 may be made with a tailor-made strength profile for particular strength applications. Further, raw material defects such as knots will be well distributed throughout the structure because each knot will have a thickness that is no thicker than the width W1 of the laminations 24. The width W1 of the laminations 24 is relatively small when compared to the thickness or width W2 of the laminated billet 22.

Yet another advantage of the embodiments of the support mat 20 described herein is that the support mat 20 has a weight that is within the range of from about 25 percent to about 60 percent lighter than prior art mats having the same surface area, such as for example, the mat 10. In the embodiment illustrate in FIG. 2 for example, the weight of the support mat 20 is about 50 percent of the weight of a prior art mat having the same surface area, such as the mat 10.

In another embodiment of the support mat 20, some or all of the individual wood laminations 24 may be reinforced with a reinforcement material to make them capable of withstanding greater loads. The reinforcement material may be any material suitable for improving the strength of the overall billet 22 and the mat 20. For example, a layer of woven or nonwoven fiberglass strands, steel, or other metals and nonmetals may be applied between adjacent laminations 24 and/or between adjacent billets 22.

The principle and mode of operation of the laminated support mat and its method of manufacture have been described in its various embodiments. However, it should be noted that the laminated support mat and its method of manufacture described herein may be practiced otherwise than as specifically illustrated and described without departing from its scope.

What is claimed is:

1. A support mat comprising:

a plurality of billets fastened together, each of said billets comprising a plurality of vertically oriented individual wood laminations adhesively bonded to each other, said plurality of individual wood laminations having wide faces oriented parallel to a direction of a load applied to said support mat, each billet having outboard laminations, said wide faces of said outboard laminations of each billet defining a wide face of said billet;

an expansion pad disposed between the wide faces of adjacent billets, the expansion pad permitting the asymmetrical expansion of the billets; and a substantially rigid fastener extending through and connecting said expansion pad and adjacent billets;

wherein said billets, expansion pad, and fastener define a substantially rigid support mat having a substantially planar wide face.

2. The support mat according to claim 1, wherein said expansion pad has a thickness within the range of from about 0.375 inches to about 0.625 inches.

3. The support mat according to claim 1, wherein said expansion pad has a thickness of about 0.375 inches.

4. The support mat according to claim 1, wherein said expansion pad has a length within the range of from about 3 inches to about 12 inches.

5. The support mat according to claim 1, wherein said expansion pad has a maximum length of about 12 inches.

6. The support mat according to claim 1, wherein said wide face of said billet has a height, and wherein said expansion pad has a height within the range of about 70 percent to about 80 percent of the height of said wide face of said billet.

7. The support mat according to claim 1, wherein said wide face of said billet has a height, and wherein said expansion pad has a height of about 75 percent of the height of said wide face of said billet.

8. The support mat according to claim 1, wherein said expansion pad is formed from a material selected from the group consisting of chloroprene rubber, polychloroprene rubber, and natural rubber.

9. The support mat according to claim 1, wherein said expansion pad is formed from a material having the properties of a shore A hardness within the range of from about 40 to about 50, an elongation at rupture within the range of from about 100 percent to about 70 percent, and a moderate resistance to weathering, ozone, gas, diesel, mineral oil, and hydraulic fluid.

10. The support mat according to claim 1, wherein said support mat includes a plurality of expansion pads disposed between said wide faces of adjacent billets.

11. The support mat according to claim 10, wherein a center of each expansion pad is spaced about 24 inches from a center of an adjacent expansion pad.

12. The support mat according to claim 1, wherein said support mat has an aspect ratio greater than 13.

13. A support mat comprising:

a plurality of billets fastened together to define a substantially symmetrically shaped support mat having a substantially flat first support surface and a substantially flat second support surface opposite said first support surface, each of said billets comprising a plurality of vertically oriented individual wood laminations adhesively bonded to each other, said plurality of individual wood laminations having wide faces oriented parallel to a direction of a load applied to said support mat, each billet having outboard laminations, said wide faces of said outboard laminations of each billet defining a wide face of said billet; and an expansion pad compressed between the wide faces of adjacent billets;

wherein when a portion of said support mat is exposed to one of water and moisture over a period of time, said support mat expands asymmetrically; and wherein when said support mat expands asymmetrically, said first and second support surfaces remain substantially flat.

14. The support mat according to claim 13, wherein said expansion pad has a thickness within the range of from about 0.375 inches to about 0.625 inches.

15. The support mat according to claim 13, wherein said expansion pad has a length within the range of from about 3 inches to about 12 inches.

16. The support mat according to claim 13, wherein said wide face of said billet has a height, and wherein said expansion pad has a height within the range of about 70 percent to about 80 percent of the height of said wide face of said billet.

17. The support mat according to claim 13, wherein said expansion pad is formed from a material having the properties of a shore A hardness within the range of from about 40 to about 50, an elongation at rupture within the range of from about 100 percent to about 70 percent, and a moderate resistance to weathering, ozone, gas, diesel, mineral oil, and hydraulic fluid.

18. The support mat according to claim 13, wherein said support mat includes a plurality of expansion pads disposed between said wide faces of adjacent billets.

19. A support mat comprising:

a plurality of billets fastened together to define a substantially symmetrically shaped support mat having a substantially flat first support surface and a substantially flat second support surface opposite said first support surface, each of said billets comprising a plurality of vertically oriented individual wood laminations adhesively bonded to each other, said plurality of individual wood laminations having wide faces oriented parallel to a direction of a load applied to said support mat, each billet having outboard laminations, said wide faces of said outboard laminations of each billet defining a wide face of said billet; and an expansion pad disposed between the wide faces of adjacent billets;

wherein when a portion of said support mat is exposed to one of water and moisture over a period of time, said support mat expands asymmetrically;

wherein when said support mat expands asymmetrically, said first and second support surfaces remain substantially flat; and wherein when said support mat is used to support objects, said support mat may be positioned relative to the ground such that either of said first and second support surfaces is oriented to support said objects.

20. The support mat according to claim 19, wherein said support mat includes a plurality of expansion pads disposed between said wide faces of adjacent billets.

21. A support mat comprising:

a plurality of billets fastened together, each of said billets comprising a plurality of vertically oriented individual wood laminations adhesively bonded to each other, said plurality of individual wood laminations having wide faces oriented parallel to a direction of a load applied to said support mat, each billet having outboard laminations, said wide faces of said outboard laminations of each billet defining a wide face of said billet; and an expansion pad compressed between the wide faces of adjacent billets;

wherein said expansion pad is formed from a material having the properties of a shore A hardness within the range of from about 40 to about 50, an elongation at rupture within the range of from about 100 percent to about 70 percent, and a moderate resistance to weathering, ozone, gas, diesel, mineral oil, and hydraulic fluid.

22. The support mat according to claim 21, further including a substantially rigid fastener extending through and connecting said expansion pad and adjacent billets;

wherein said billets, expansion pad, and fastener define a substantially rigid support mat having a substantially planar wide face.

23. A support mat comprising:

a plurality of billets fastened together, each of said billets comprising a plurality of vertically oriented individual wood laminations adhesively bonded to each other, said plurality of individual wood laminations having wide faces oriented parallel to a direction of a load applied to said support mat, each billet having outboard laminations, said wide faces of said outboard laminations of each billet defining a wide face of said billet;

an expansion pad disposed between the wide faces of adjacent billets, wherein said expansion pad is formed from a material selected from the group consisting of chloroprene rubber, polychloroprene rubber, and natural rubber; and a substantially rigid fastener extending through and connecting said expansion pad and adjacent billets;

wherein said billets, expansion pad, and fastener define a substantially rigid support mat having a substantially planar wide face.

24. A support mat comprising:

a plurality of billets fastened together, each of said billets comprising a plurality of vertically oriented individual wood laminations adhesively bonded to each other, said plurality of individual wood laminations having wide faces oriented parallel to a direction of a load applied to said support mat, each billet having outboard laminations, said wide faces of said outboard laminations of each billet defining a wide face of said billet;

an expansion pad disposed between the wide faces of adjacent billets, wherein said expansion pad is formed from a material having the properties of a shore A hardness within the range of from about 40 to about 50, an elongation at rupture within the range of from about 100 percent to about 70 percent, and a moderate resistance to weathering, ozone, gas, diesel, mineral oil, and hydraulic fluid; and a substantially rigid fastener extending through and connecting said expansion pad and adjacent billets;

wherein said billets, expansion pad, and fastener define a substantially rigid support mat having a substantially planar wide face.

* * * * *